US006048135A

United States Patent [19]

Williford et al.

[11] Patent Number: 6,048,135

[45] Date of Patent: Apr. 11, 2000

[54] MODULAR OFFSHORE DRILLING UNIT AND METHOD FOR CONSTRUCTION OF SAME

[75] Inventors: Frank B. Williford, Frisco; Thomas C. Baucke, Dallas, both of Tex.

[73] Assignee: Ensco International Incorporated, Dallas, Tex.

[21] Appl. No.: 08/947,488

[22] Filed: Oct. 10, 1997

[51] Int. Cl.[7] ..... E02B 17/04

[52] U.S. Cl. ..... 405/196; 405/195.1; 405/203

[58] Field of Search ..... 114/65 R, 77 R, 114/264, 265, 266, 267; 405/195.1, 196, 197, 198, 199, 200, 203, 204, 205, 208, 211

[56] References Cited

U.S. PATENT DOCUMENTS

| | | | |
|---|---|---|---|
| 3,001,594 | 9/1961 | Suderow | 175/9 |
| 3,716,993 | 2/1973 | Sumner | 61/46.5 |
| 3,874,180 | 4/1975 | Sumner | 61/46.5 |
| 3,934,658 | 1/1976 | Nelson | 175/7 |
| 3,946,684 | 3/1976 | Sumner | 114/0.5 |
| 3,948,056 | 4/1976 | Sumner | 61/46 |
| 3,974,657 | 8/1976 | Sumner | 61/50 |
| 4,038,830 | 8/1977 | Sumner | 61/89 |
| 4,056,943 | 11/1977 | Tarrant | 61/96 |
| 4,360,291 | 11/1982 | Cranberg et al. | 405/205 |
| 4,422,803 | 12/1983 | Wetmore | 405/204 |
| 4,456,404 | 6/1984 | Evans | 405/203 |
| 4,486,125 | 12/1984 | Reusswig | 408/217 |
| 4,492,270 | 1/1985 | Horton | 166/358 |
| 4,505,615 | 3/1985 | Evans | 405/205 X |
| 4,511,288 | 4/1985 | Wetmore | 405/217 |
| 4,602,894 | 7/1986 | Lorenz et al. | 405/203 |
| 4,625,805 | 12/1986 | Ladecky | 166/341 |
| 5,292,207 | 3/1994 | Scott | 405/211 X |
| 5,356,239 | 10/1994 | Canton | 405/227 |

OTHER PUBLICATIONS

"A Primer of Offshore Operations", Second Edition, by Ron Baker, Petroleum Extension Service, Division of Continuing Education, The University of Texas at Austin, 1985.

*Primary Examiner*—Eileen Dunn Lillis
*Assistant Examiner*—Frederick L. Lagman
*Attorney, Agent, or Firm*—Jenkens & Gilchrist, P.C.

[57] ABSTRACT

A mobile offshore drilling unit includes a hull member having an opening of predetermined size for receiving a separately fabricated, interchangeable, rig block, which further includes a draw works, a drilling floor, a diesel driver, an electric generator, a derrick, and at least one each of a mud pump, mud tank, a fuel tank, and a drilling water tank. The method of constructing such a unit includes constructing the hull member at a marine shipyard and fabricating the interchangeable rig block at a remote location. The rig block is constructed with the main deck having a drilling floor and mounting a draw works thereon; constructing a machinery deck with a diesel driver, an electric generator, and at least one mud pump; and constructing a tank deck with at least one each of a fuel tank and a water tank.

19 Claims, 9 Drawing Sheets

MODULAR OFFSHORE DRILLING UNIT AND METHOD FOR CONSTRUCTION OF SAME

TECHNICAL FIELD

This invention relates to mobile offshore drilling rigs and, more particularly, to a mobile offshore unit including a hull and a discrete separately fabricated modular subassembly of drilling components installed therein.

BACKGROUND OF THE INVENTION

Mobile offshore drilling units move from one drill site on the water to another and may be referred to a MODUs. There are two basic types of MODUs used to drill most offshore wells: (1) bottom supported units including submersibles and jack-ups; and (2) floating units including lake barge rigs, drill ships, and semi-submersibles.

Submersible MODUs include swamp barges (sometimes referred to as inland barges) which are used in calm, shallow water environments. A swamp barge comprises a barge hull with drilling rig components mounted thereon. A swamp barge rig is moved from location to location in a floating mode. When the rig reaches a prospective drilling location, a portion of the barge hull is flooded and the barge partially submerges and rests on the bottom of the water body or swamp.

Jack-up MODUs include a large generally triangular-shaped barge hull on which the rig floats when it is being towed from one location to another. The barge hull of a jack-up is commonly referred to in the industry as the platform. Most jack-up rigs have three or four legs which pass through the platform and are connected to a jacking means. When a jack-up is positioned at the prospective well site, the legs are jacked down in contact with the bottom of the water body. When the legs contact the bottom, the platform is jacked up above the wave line. Jack-ups are used in water depths up to about 350 feet.

Lake barge rigs, drill ships, and semi-submersibles are floating units typically used in water depths greater than where a swamp barge or jack-up is applicable. Drill ships are self-propelled and, therefore, incorporate transportation advantages over other MODU rig types which are typically towed from one location to another. Drill ships are best suited for drilling in deep, open waters far removed from shore. A drill ship has a drilling rig mounted in the middle and includes an opening, referred to in the industry as a moon pool, through which drilling operations are conducted. Drill ships are less desirable than semi-submersibles for use in rough water. Semi-submersibles include a lower barge hull which floats below the surface of the sea and is, therefore, not subject to surface wave action. Large stability columns mounted on the lower barge hull support the upper hull, which includes a main deck and machinery deck above the surface of the water.

Lake barges are very similar in construction to swamp barges in that they include a barge on which the drilling rig is mounted. However, in the lake barge rig, the barge element is not intended to be submerged. A lake barge rig is transported in a floating mode but also drills in a floating mode. Lake barges are especially applicable to calm deep water environments. One such environment is Lake Maracaibo in Venezuela. The water is calm but too deep for a swamp barge to rest on bottom. The bottom of the lake is covered in pipelines; therefore, it is not desirable to use a jack-up for fear of piercing one of the pipelines with a leg of the jack-up. Therefore, a floating lake barge is desirable.

Turning now to historical construction techniques for MODUs, several specialized shipyards such as Bethlehem and LeTourneau constructed a substantial portion of the world's fleet of MODUs. Historically, the yards constructed the floating member (hull) first and then added the drilling rig elements, component by component, to the previously constructed hull. The drilling components were not assembled first and then placed as a unit on the hull.

A downturn in the worldwide oil industry in the late 1980's and early 1990's resulted in an oversupply of MODUs. There was virtually no need for construction of new MODUs and many marine shipyards which specialized in building MODUs closed. Those that survived shifted the focus of their construction to other products. The offshore oil industry is now in an upturn and utilization rates for MODUs in some areas have reached over 90 percent.

Presently, most existing shipyards have expertise in building vessels and equipment necessary to construct the floating member (hull) of a MODU. However, such shipyards do not presently have the expertise to efficiently assemble the drilling rig components of the MODU, having shifted the focus of their operations to other products. On the other hand, manufacturers of drilling rig components and contractors who specialize in assembly of land drilling rigs do not have the facilities or expertise to build the hull members of the MODU.

As the currently working rigs age and new rigs are needed to replace them, a demand for a simple, cost effective design and construction techniques for MODUs is desirable. The present invention comprising a mobile offshore drilling unit including a discrete separately fabricated modular subassembly of drilling components (referred to herein as the "rig block") installed on a separately assembled hull meets this need.

SUMMARY OF THE INVENTION

In accordance with the present invention many of the disadvantages in prior art design and prior art construction techniques for MODUs have been overcome. The present invention comprises a mobile offshore drilling unit including a discrete separately fabricated modular subassembly of drilling components (referred to herein as the "rig block") installed on a separately assembled hull. The rig block may be fabricated by contractors familiar with drilling rig construction and not in the marine shipyard where the hull is being fabricated. This enables the shipyard to use its expertise to construct the hull and allows rig fabricators to use their expertise to fabricate the rig block. This type of construction further allows interchangeability of the rig block among the differing hull types leading to construction time savings, repair time savings, minimized down time, etc.

BRIEF DESCRIPTION OF THE DRAWINGS

A more complete understanding of the invention may be had by reference to the following Detailed Description when taken in conjunction with the accompanying Drawings in which.

DETAILED DESCRIPTION

Figure 1:
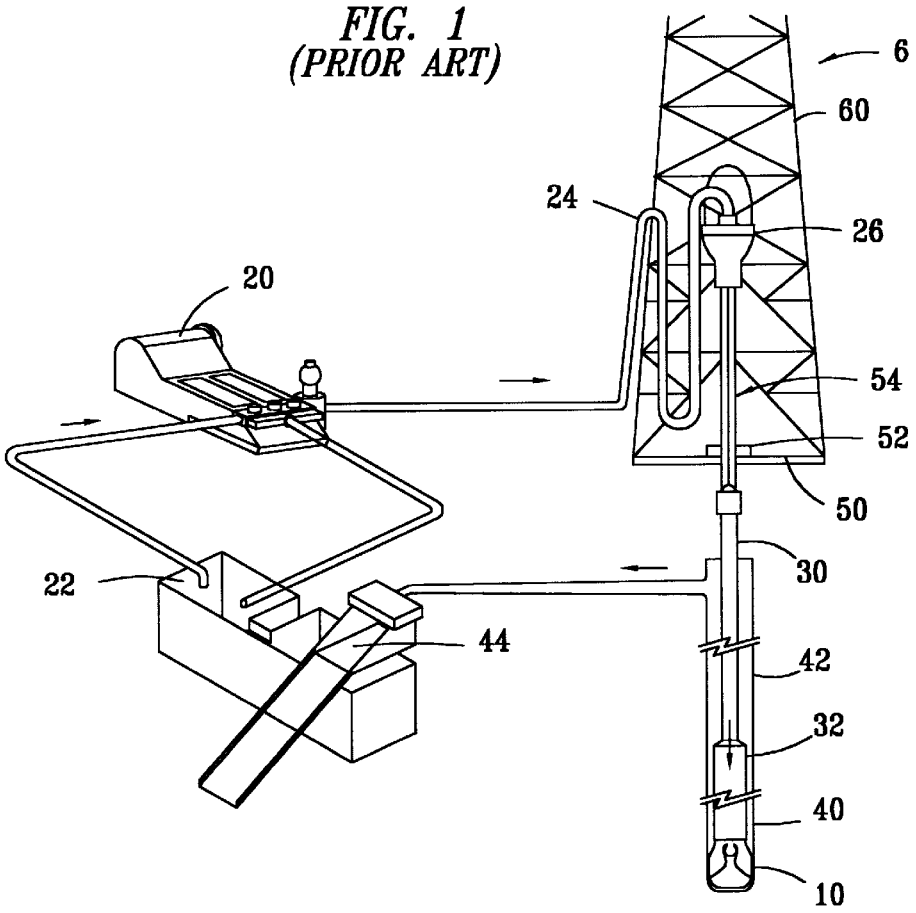
FIG. 1 (PRIOR ART)
FIG. 1 is a schematic of a prior art drilling rig system.

Reference is now made to the Drawings wherein like reference characters denote like or similar parts throughout the FIGURES. In order to understand and appreciate the benefits of the present invention, it is useful to discuss the very basic components used on a drilling rig. Generally, the same basic drilling components are used on both land based drilling rigs and mobile offshore drilling units ("MODUs"). The present invention aggregates most of the drilling components in a specific identifiable sub-assembly referred to as "a rig block." This type of construction allows interchangeability of the blocks among the differing types of MODUs leading to construction time savings and repair time savings, minimized down time, etc. Additionally, rig blocks of differing depth capabilities may be interchanged on the same MODU. Most importantly, the rig block may be fabricated by contractors familiar with drilling rig construction.

Referring to FIG. 1, therein is illustrated a schematic of a drilling rig. Put very simply, a drilling rig 6 is a portable factory for making deep holes in the ground. When a bit 10 is pressed against the ground and rotated, the teeth on the bit 10 grind and gouge the rock into small pieces. These pieces of rock or cuttings must be moved out of the way so the bit teeth can be constantly exposed to fresh, uncut rock. A special liquid called drilling fluid or mud is used to move the cuttings away from the bit. A mud pump 20 takes mud from mud tanks 22 and pumps it under high pressure up a standpipe 24, through the swivel 26, down the kelly 54, down the drill pipe 30, through the drill collars 32 and out jets in the bit 10. Mud, exiting under pressure from jets in the bit 10, clears the cuttings and moves then up the annulus 42 of the bore hole 40. The mud and cuttings are then passed over a shale shaker 44 which separates the cuttings from the mud and allows the mud to return to the mud tank 22 for recirculation. The cuttings are sampled periodically for geologic purposes, but most are discarded.

Since the drill bit must be rotated to make a hole, the rotary system is one of the most important parts of the drilling rig 6. The main part of the system is the drilling floor 50 and rotary table 52. Located near the center of the rotary table 52 is a kelly bushing and kelly 54. It is well known in the art how the elements of the rotary system impart rotation to the drilling string. In many modern drilling units, including most MODUs, a top drive motor (not shown) positioned in the derrick on rails replaces the rotary table, kelly busing and kelly for imparting rotation to the drill string. Top drive systems are well known in the art.

Rotational force is transferred from the rotary system to the drill string comprising drill pipe 30 and drill collars 32. Drill collars are very thick walled pipe that is extremely heavy. The drill collars 32 are very stiff and assist in maintaining the bit in a vertical position. The weight of the drill collars 32 applied directly above the bit assists in increasing the cutting ability of the bit 10.

Figure 2:
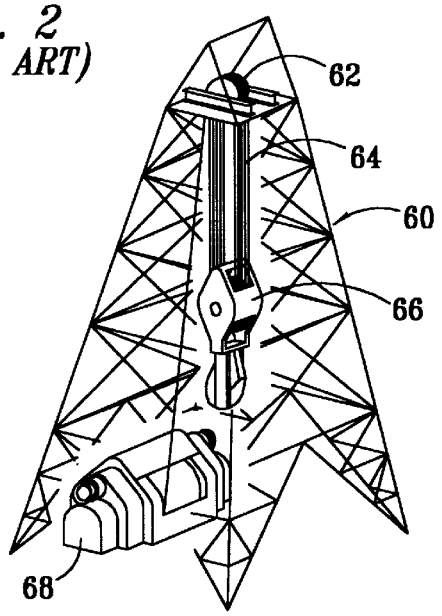
FIG. 2 (PRIOR ART)
FIG. 2 is a schematic of a prior art drilling rig derrick and associated components.

Wells are now being drilled to depths in excess of 30,000 feet. The tremendous weight of the drill string and drill collars must be supported by a substantial derrick 60. Referring now to FIG. 2, drilling line 64 is attached to traveling block 66, sheaved over crown block 62 and attached to draw works 68. The draw works 68 is a specialized winch which is used to hoist the drill string comprising the drill pipe 30, drill collars 32 and bit 10 out of the hole. The drilling equipment as discussed above is well known and understood by those skilled in the art.

Any drilling unit needs power to the turn the bit, power to drive the mud pump and power to run all the ancillary machinery. The power system on most offshore rigs is usually diesel/electric. The prime movers, being diesel, are used to drive generators to generate electric power which is used to power the other equipment.

Figure 3:
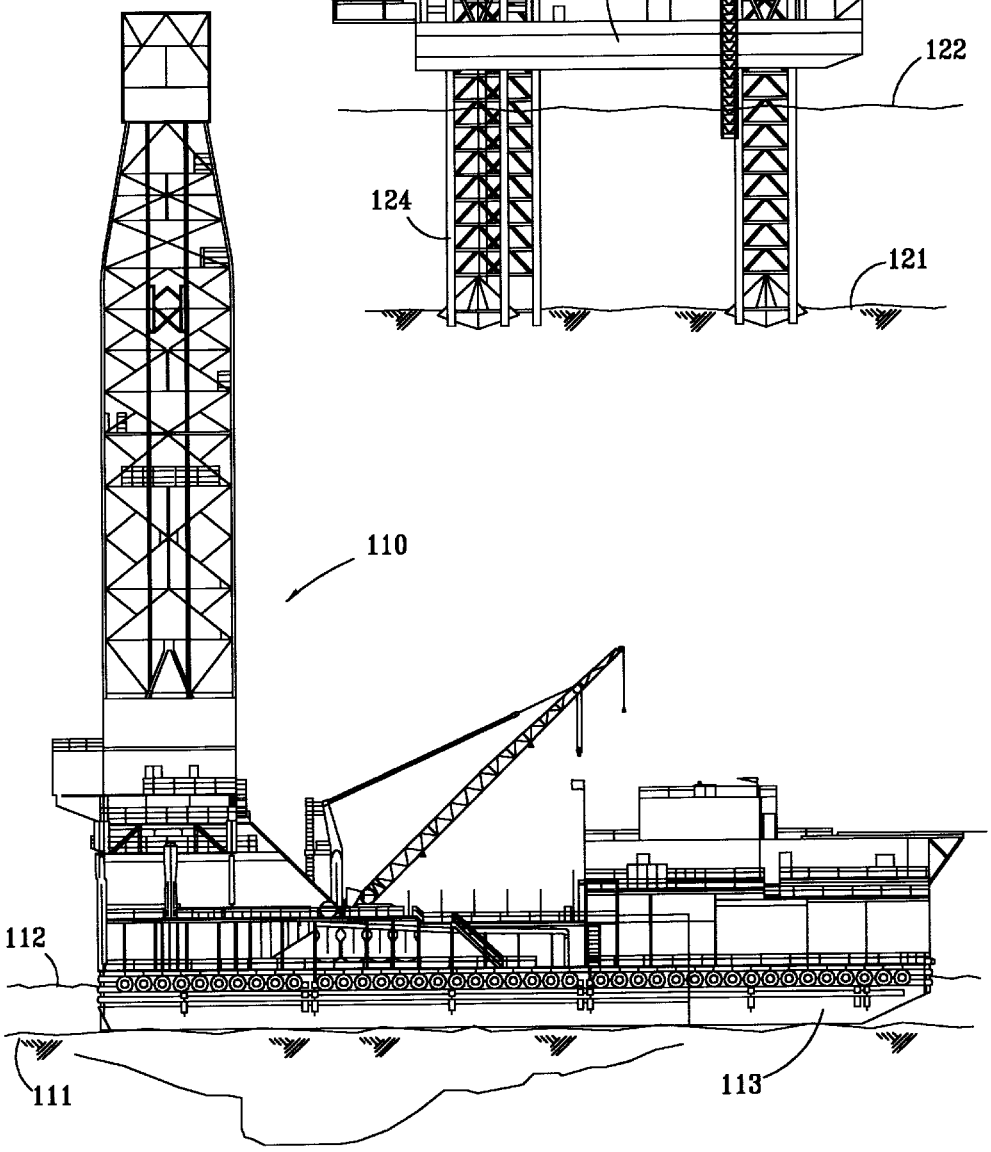
FIG. 3 (PRIOR ART)
FIG. 3 is an elevation view of a prior art submersible swamp barge rig in a drilling mode.

In addition to understanding the components of a drilling rig, it is useful for understanding the present invention to discuss prior art mobile offshore drilling units (MODUs) on which the drilling rig components as discussed above operate. Referring now to FIGS. 3–6, therein are illustrated two basic types of MODUs used to drill most offshore wells: (1) bottom supported units including submersible barge rigs and jack-ups; and (2) floating units including lake barge rigs and semi-submersibles. FIG. 3 illustrates a typical prior art bottom supported submersible barge rig typically referred to in the industry as a swamp barge. (It is understood by those skilled in the art that a posted barge (not shown) is a specialized form of the submersible barge rig). In FIG. 3, a conventional (non-posted) swamp barge 110 is illustrated in the drilling mode. In the drilling mode the bottom of a barge hull 113 rests on the bottom of the swamp or water body 111. The lower portion of the barge hull 113 is submerged below the water line 112; however, the upper portion is above the water line 112.

Figure 4:
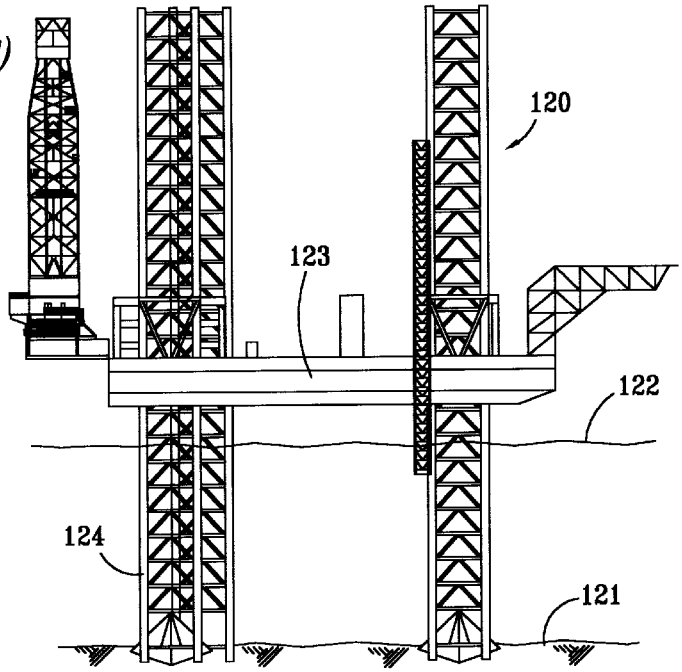
FIG. 4 (PRIOR ART)
FIG. 4 is an elevation view of a prior art jack-up rig in a drilling mode.

Referring to FIG. 4, therein is illustrated a typical prior art bottom supported jack-up rig 120 in a drilling mode. The legs 124 rest on the bottom 121. The barge hull (platform) 123 is raised above the water level 122.

Figure 5:
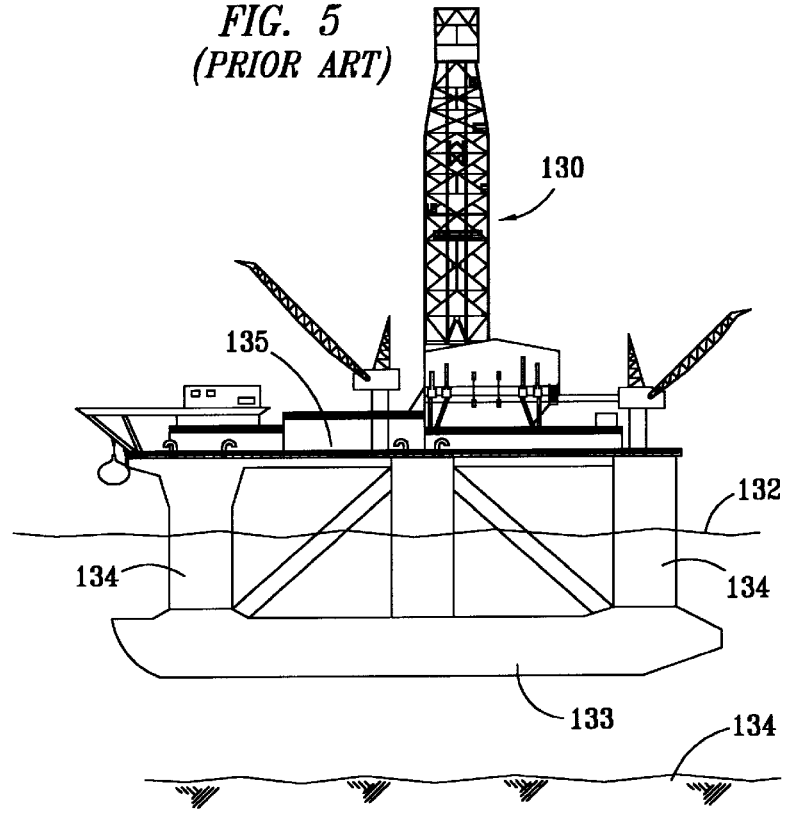
FIG. 5 (PRIOR ART)
FIG. 5 is an elevation view of a prior art semi-submersible rig in a drilling mode.

FIG. 5 illustrates a typical floating semi-submersible rig 130 in the drilling mode. The lower hull 133 is floating below the surface of the water 132. Large stability columns 134 support the upper hull 135 maintaining the machinery deck above the surface of the water 132.

Figure 6:
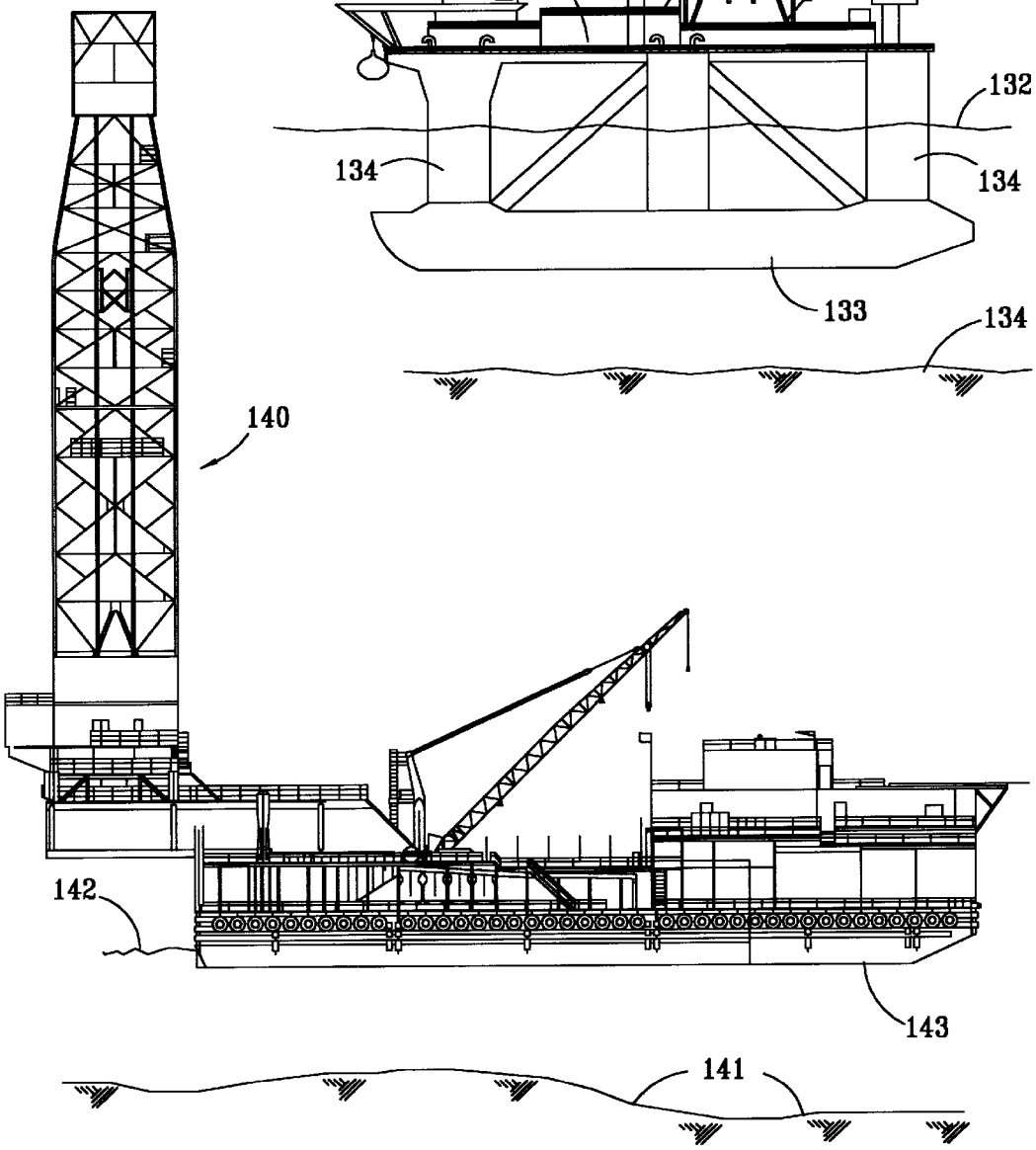
FIG. 6 (PRIOR ART)
FIG. 6 is an elevation view of a prior art floating lake barge rig in a drilling mode.

FIG. 6 illustrates a typical floating lake barge rig 140 in the drilling mode. The floating barge is similar to the submersible barge rig 110 except that the barge hull 143 floats on the surface of the water 142 and does not rest on the bottom 141.

The selection of the appropriate MODU for a job is generally based on the location of the well to be drilled, the water depth and the type of wave action. A source of additional information as known in the offshore drilling art includes the reference *A Primer of Offshore Operations* (2nd ed.) published by the Petroleum Extension Service of the University of Texas at Austin in 1985.

As appreciated by those skilled in the art, each of these MODUs costs many millions of dollars to fabricate. Historically, keeping the supply of each type of rig in balance with the demand at any one time has been difficult. This was made especially difficult because of varying exploration and development drilling trends throughout the world. It may be appreciated that it is not economically attractive to have a MODU costing many millions of dollars sitting idle. Therein is one of the additional advantages of the present invention. If a particular type of MODU is in a surplus mode, the rig block containing the capital intensive drilling rig components may be removed from the idle rig and used in a newly fabricated hull element for a different type of MODU or used as a repair or replacement rig block on any type of MODU hull constructed in accordance with the present invention.

Figure 7B:
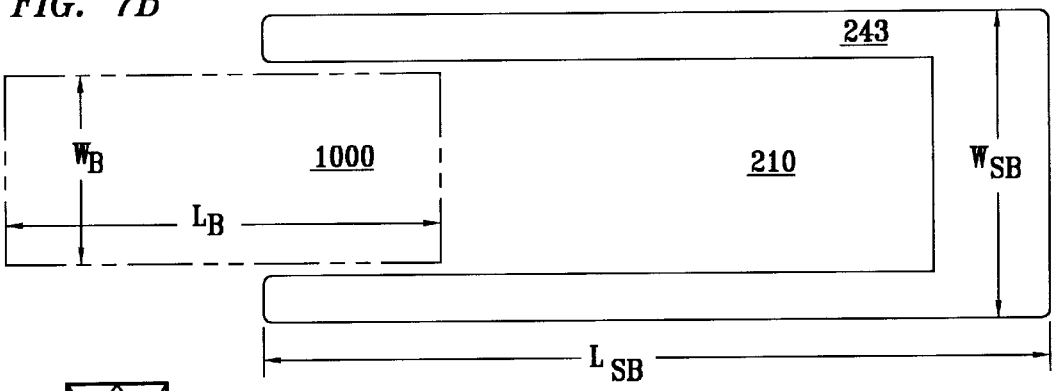
FIG. 7B is a schematic plan view of the submersible swamp barge rig of FIG. 7A including the modular rig block.
Figure 7A:
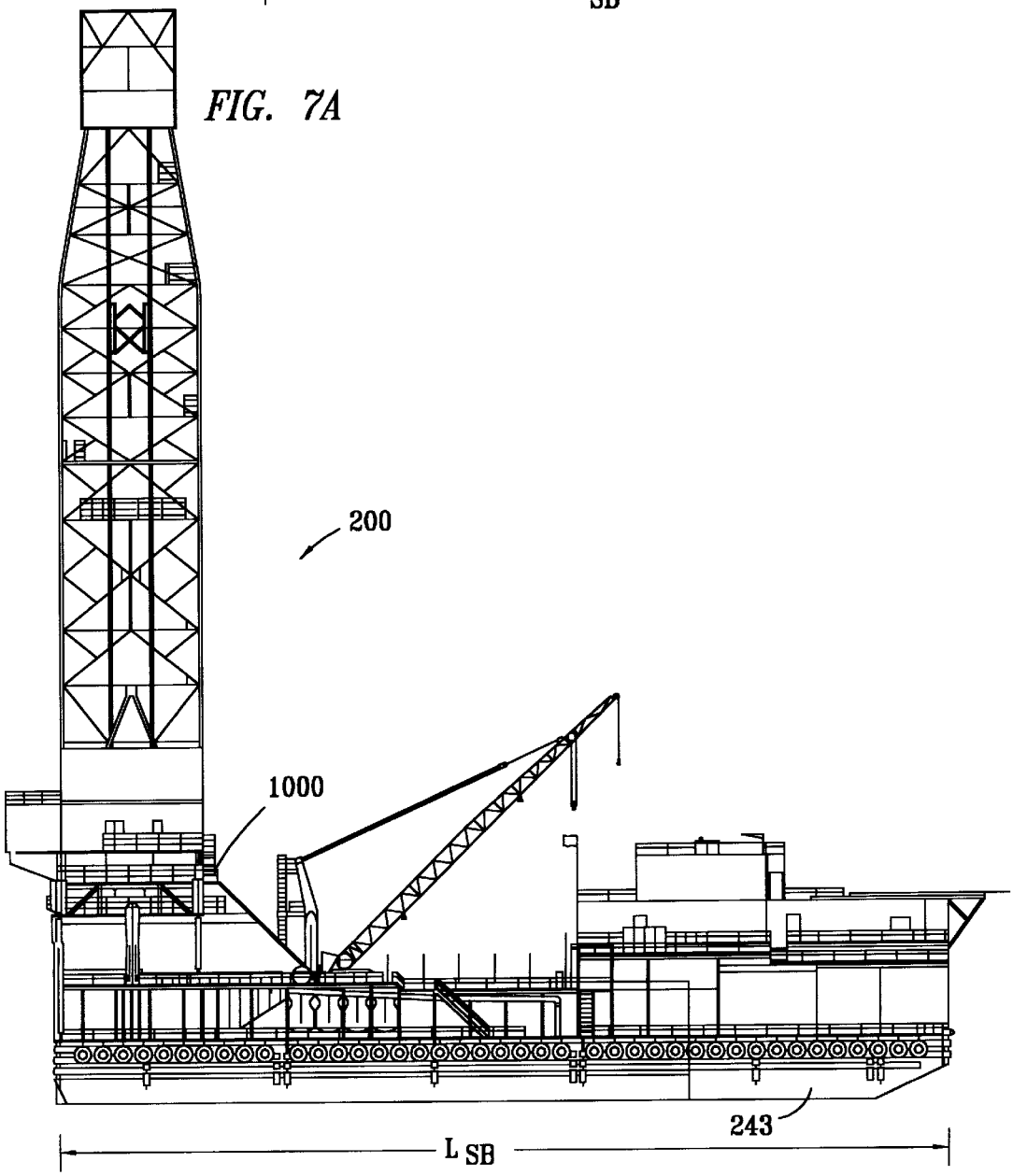
FIG. 7A is an elevation view of a submersible swamp barge rig of the present invention including a modular rig block.

Referring now to FIG. 7A, therein is illustrated an elevation view of a bottom supported submersible swamp barge rig 200 of the present invention with a rig block 1000 containing the drilling equipment installed therein. FIG. 7B is a schematic plan view illustrating the rig block 1000 being inserted in the receiving slot 210 in the barge hull 243 of the rig 200. The length $L_B$ of the rig block 1000 is 140 feet and the width of the rig block $W_B$ is 60 feet. The length $L_{SB}$ of the swamp barge hull 243 is approximately 200 feet and the width $W_{SB}$ is approximately 85 feet.

Figure 8A:
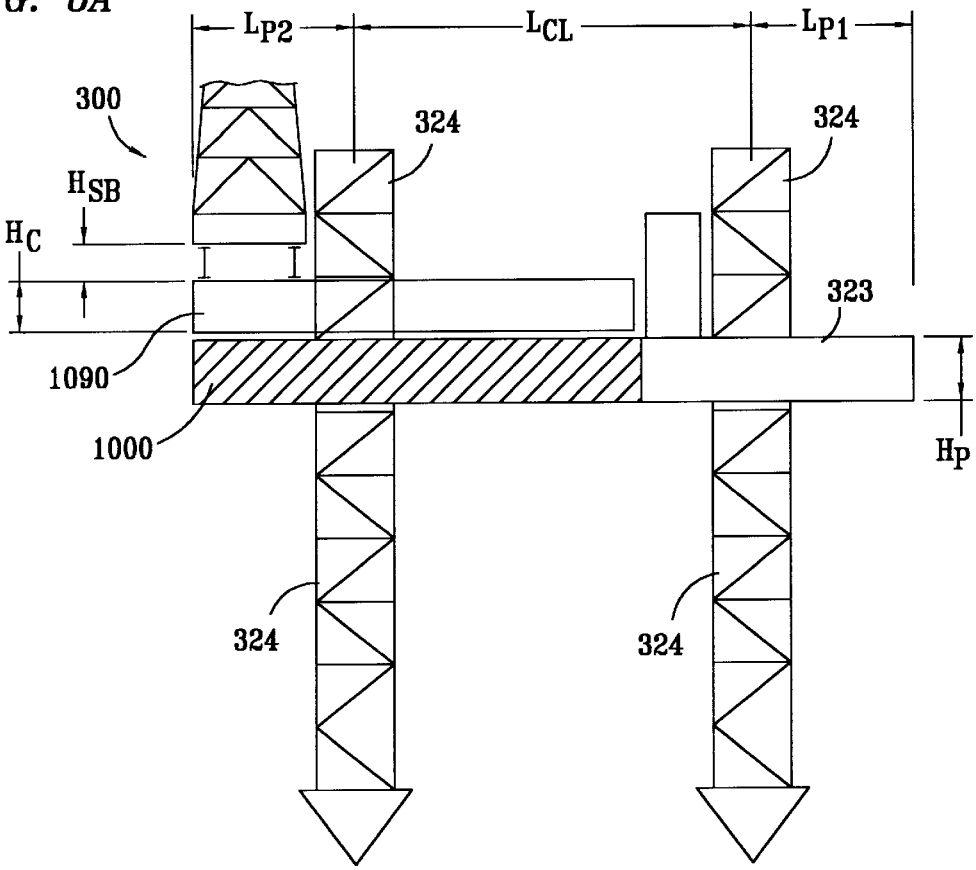
FIG. 8A is an elevation view of a jack-up rig of the present invention including a modular rig block.
Figure 8B:
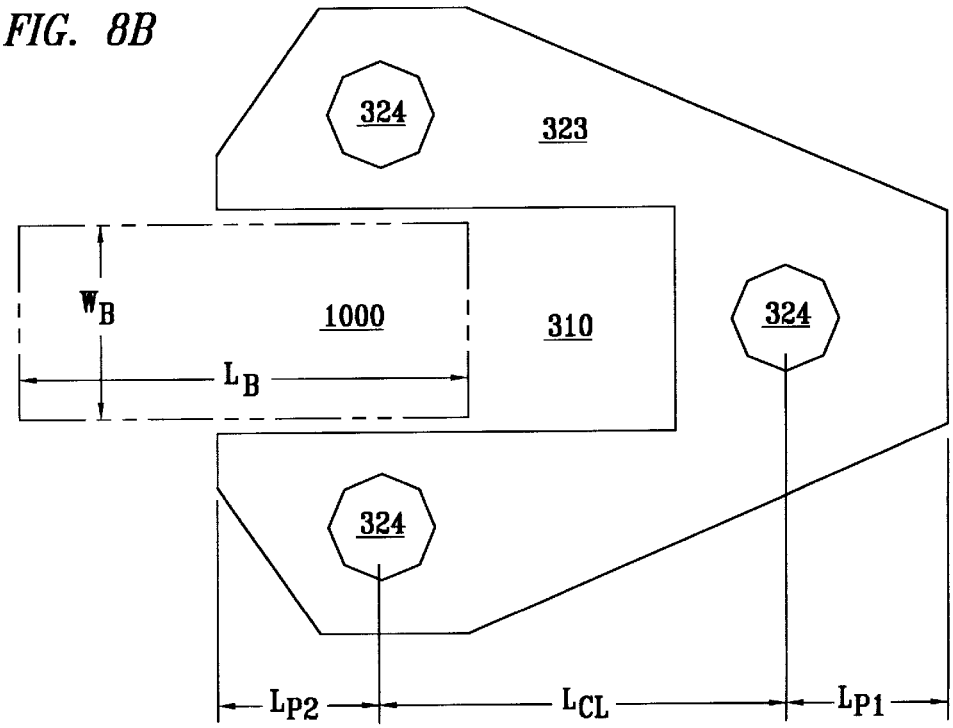
FIG. 8B is a schematic plan view of the jack-up rig of FIG. 8A including the modular rig block.

Referring now to FIG. 8A, therein is illustrated an elevation view of a jack-up rig 300 of the present invention with a rig block 1000 containing the drilling equipment installed in the platform hull 323 of the jack-up rig. Movable legs 324 pass through the platform hull 323. The platform has a height $H_P$ of approximately 25 feet. The height $H_C$ of the cantilever 1090 is approximately 20 feet and the height of the sub-base under the drill floor $H_{SB}$ is approximately 14 feet. The cantilever 1090 beams, as illustrated in FIG. 8A, are in a retracted position but may be extended such that the centerline of the drill floor is positioned up to 75 feet out from the side of the platform (see FIG. 11 and associated discussion). FIG. 8B is a schematic plan view illustrating the rig block 1000 being inserted in the receiving slot 310 in the platform 323 of the rig 300. The distance $L_{CL}$ from the centerline of the fore leg to the aft legs is approximately 130 feet and the distance from the fore leg to the front edge of the platform $L_{P1}$ is approximately 65 feet and the distance $L_{P2}$ from the aft legs to the back of the platform is approximately 55 feet. The length $L_B$ of the rig block 1000 is 140 feet and the width of the rig block $W_B$ is 60 feet.

Figure 9A:
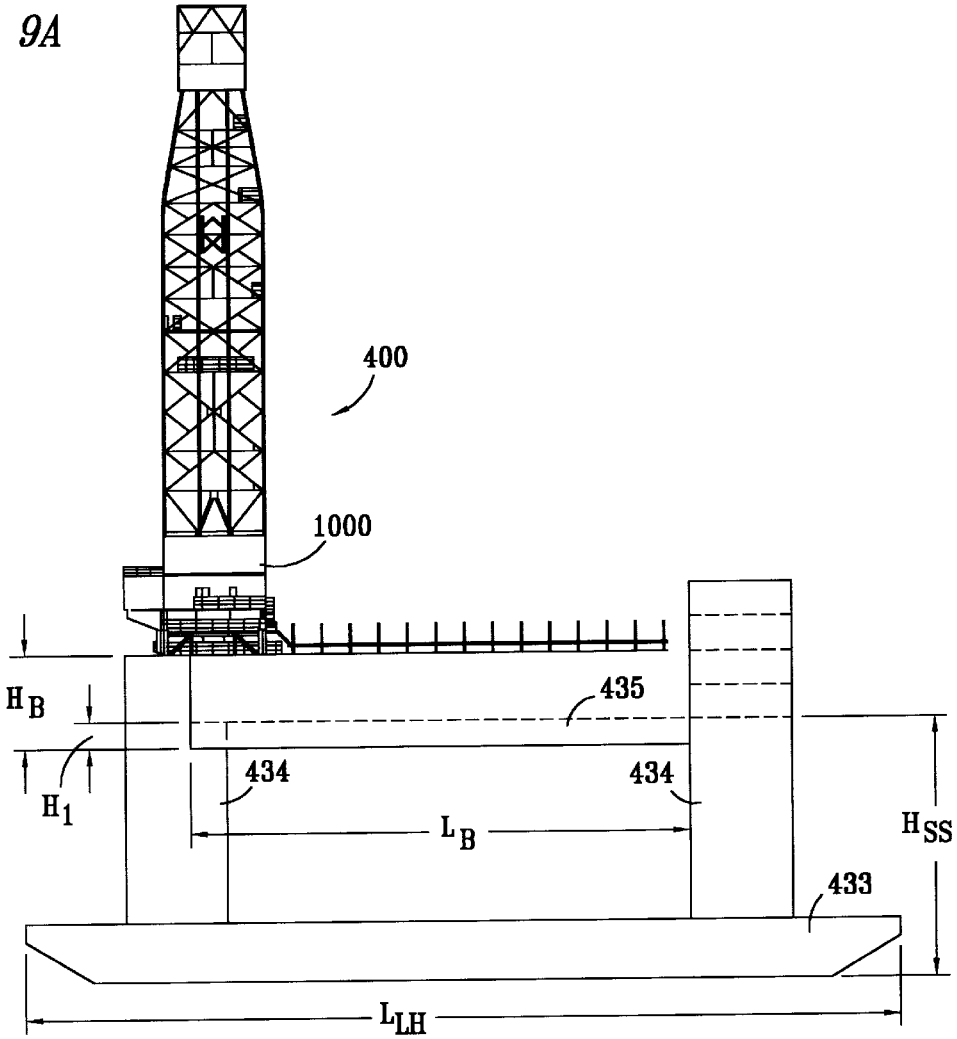
FIG. 9A is an elevation view of a semi-submersible rig of the present invention including a modular rig block.
Figure 9B:
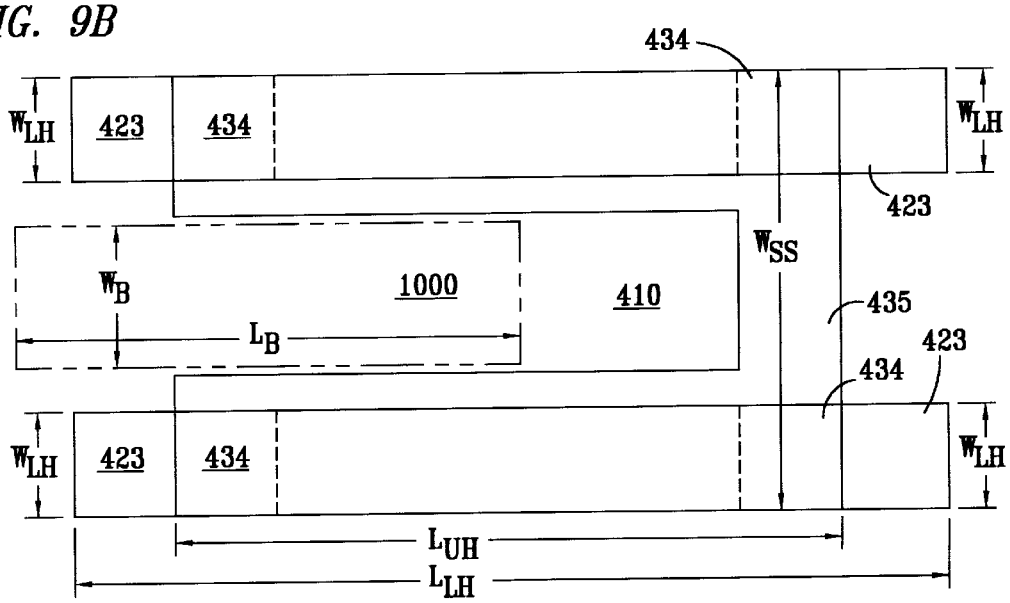
FIG. 9B is a schematic plan view of the semi-submersible rig of FIG. 9A including the modular rig block.

Referring to FIG. 9A, therein is illustrated an elevation view of a semi-submersible rig 400 of the present invention with a rig block 1000 containing the drilling equipment installed in the top hull 435 of the semi-submersible rig. The rig 400 floats on a pair of lower hulls 433. The upper hull 435 is supported on stability columns 434. The distance $H_{SS}$ from the bottom of the lower hull 433 to the bottom of the upper hull 435 is approximately 95 feet. The height of the rig block 1000 inserted in the upper hull 435 is 26 feet. The rig block 1000 is deeper than the upper hull 435 and extends below the upper hull 435 a distance $H_1$ of 6 feet. FIG. 9B is a schematic plan view illustrating the rig block 1000 being inserted in the receiving slot 410 in the upper hull 435 of the rig 400. The length $L_B$ of the rig block 1000 is 140 feet and the width of the rig block $W_B$ is 60 feet. The length of the lower hull $L_{LH}$ is approximately 280 feet and the length of the upper hull $L_{UH}$ is approximately 200 feet. The width $W_{SS}$ of the semi-submersible from outside to outside of the lower hull is approximately 170 feet. The width $W_{LH}$ of each lower hull is approximately 40 feet.

Figure 10B:
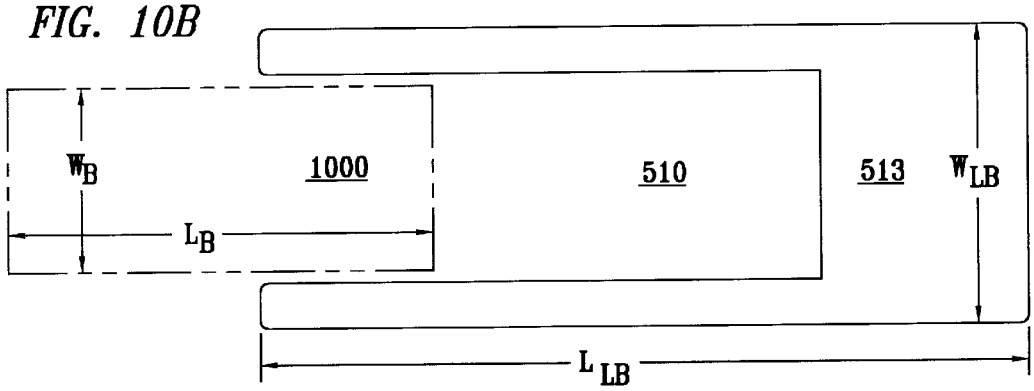
FIG. 10B is a schematic plan view of the lake barge rig of FIG. 10A including the modular rig block.
Figure 10A:
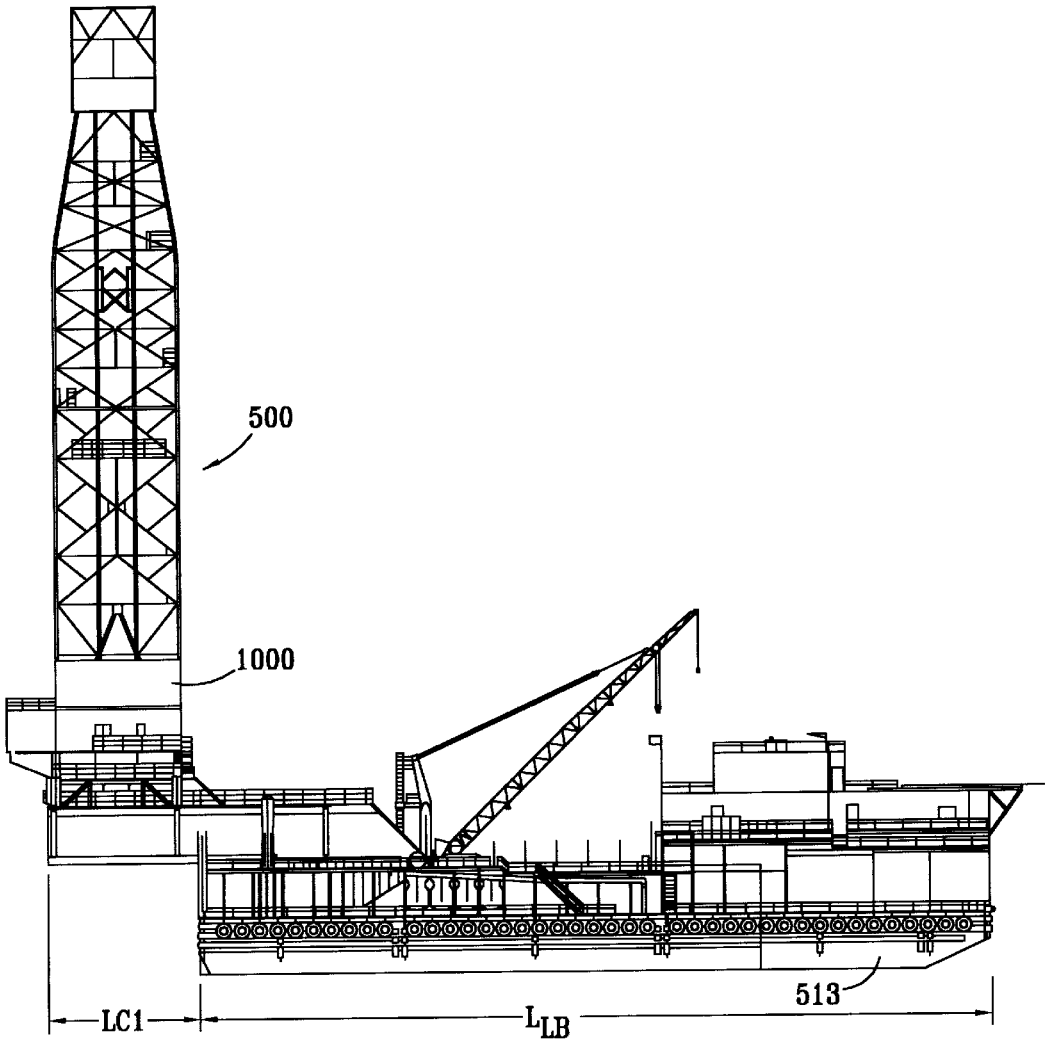
FIG. 10A is an elevation view of a lake barge rig of the present invention including a modular rig block.

Referring to FIG. 10A, therein is illustrated an elevation view of a lake barge rig 500 of the present invention with a rig block 1000 containing the drilling equipment installed in the barge hull 513 of the lake barge rig. The rig 500 floats on the barge hull 513. FIG. 10B is a schematic plan view illustrating the rig block 1000 being inserted in the receiving slot 510 in the barge hull 513 of the rig 500. The length $L_B$ of the rig block 1000 is 140 feet and the width of the rig block $W_B$ is 60 feet. The length $L_{LB}$ of the lake barge hull 243 is approximately 200 feet and the width $W_{LB}$ is approximately 85 feet. The derrick of the rig block 1000 is cantilevered approximately a distance $L_{C1}$ of 35 feet from the edge of the barge hull 513.

Figure 11:
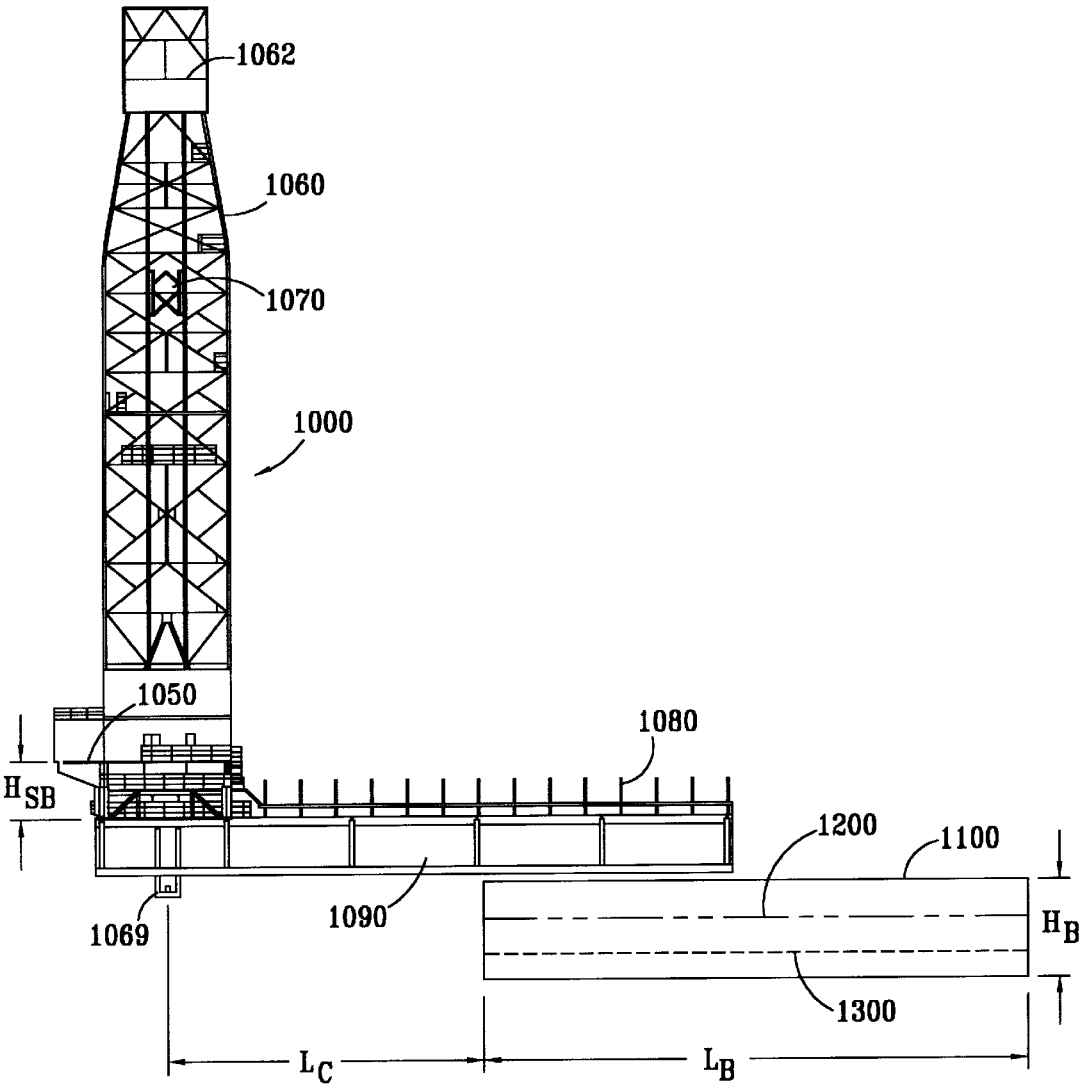
FIG. 11 is an elevation view of the rig block of the present invention.

Referring now to FIG. 11, therein is illustrated an elevation view of the rig block 1000 of the present invention. The rig block contains the conventional elements of a derrick 1060, a top power drive 1070 mounted in the derrick, and a drill floor 1050. The derrick 1060 and drill floor 1050 are mounted on a slidable cantilever beam 1090. The cantilever beam 1090 is slidably mounted, as is well known in the art, in order to cantilever the rig derrick 1050 away from the barge hull of the vessel in which it is mounted. Precision positioning of the MODU itself is difficult. The cantilever beam allows precision positioning of the derrick 1060 over an existing offshore platform or sub-sea template. The cantilever beam also allows flexibility in moving the derrick 1060 into position for drilling additional wells at proximal locations. In the embodiment of FIG. 11, the centerline 1069 of the derrick 40 is displaced a distance $L_C$ of 75 feet from the edge of the barge hull 513 or platform hull 323 (See FIGS 10A and 8A). It will be understood by those skilled in the art that the derrick 1060 and cantilever beam 1090 may be retracted toward the barge hull 513 or platform hull 323 (See FIGS 10A and 8A) of the MODU to select a precision drilling position or fully retracted over the barge hull 513 or platform hull 323 during a transportation mode.

Figure 12:
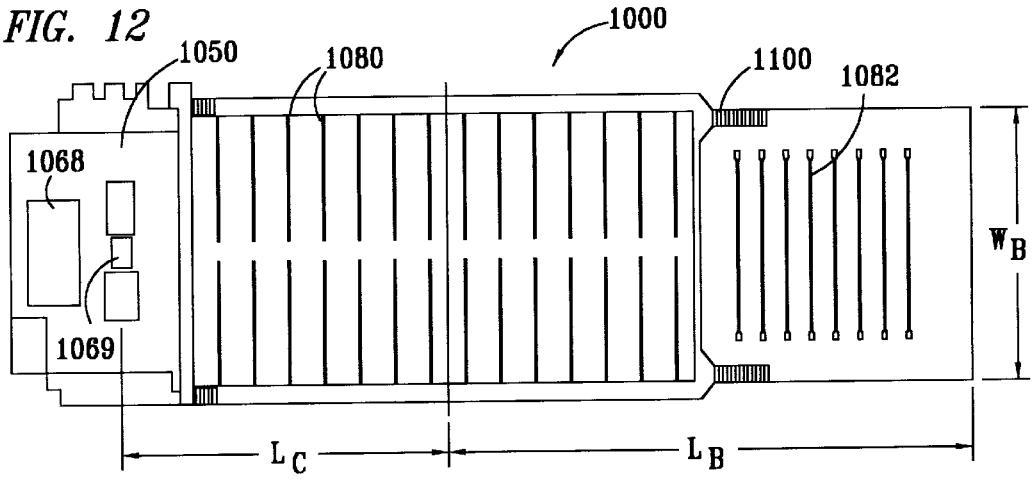
FIG. 12 is a plan view of the main deck of the rig block of FIG. 11.

Rig block 1000 preferably includes three decks: a main deck 1100; a machinery deck 1200; and a tank deck 1300. It will be understood by those skilled in the art that the decks 1000, 1200 and 1300 include conventional plating and supporting structural steel elements not illustrated herein. The steel elements scantlings are as described in the relevant sections of AISC Manual for Steel Construction and Classification Society Rules for building and classifying steel vessels and MODUs. Referring now to FIG. 12, therein is illustrated a plan view of the main deck 1100 of the rig block 1000. The main deck 1100 includes the drill floor 1050 and draw works 1068 mounted thereon and a plurality of pipe racks 1080 and 1082. Pipe racks 1080 and 1082 are used to hold drill pipe 30 and drill collars 32 before they are picked up and run in the bore hole 40 (FIG. 1). In the preferred embodiment of the present invention, the length of the drill block $L_B$ is standardized at 140 feet and the width of the drill block $W_B$ is 60 feet.

Figure 13:
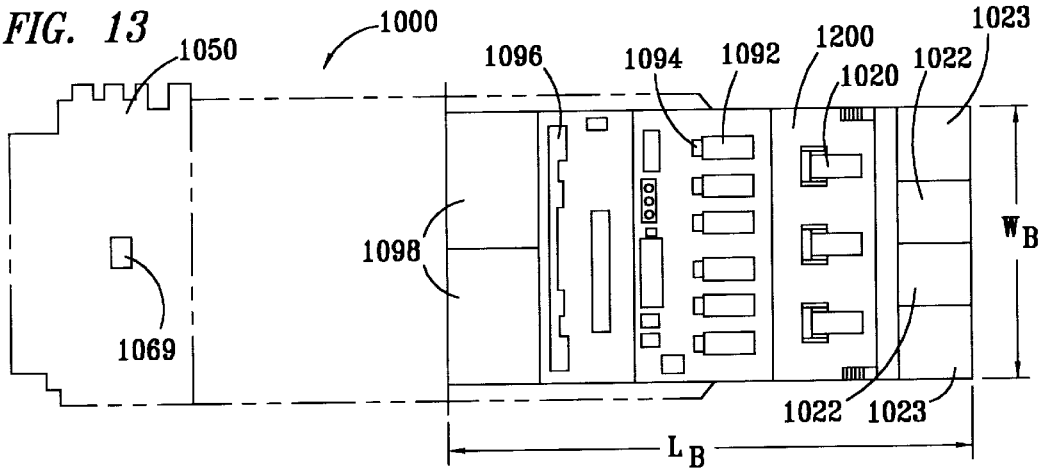
FIG. 13 is a plan view of the machinery deck of the rig block of FIG. 11.

Referring now to FIG. 13, therein is illustrated the machinery deck 1200. The machinery deck is positioned below the cantilever beam. The machinery deck includes a diesel/electric power system comprising diesel drivers 1092 and electric generators 1094 and a plurality of electrical SCR control panels 1096. One important feature of the modular construction of the present invention is the use of more and smaller engines in the SCR power systems as opposed to conventional larger engines. The machinery deck further includes mud pumps 1020 and mud tanks 1022, reserve mud tanks 1023 and pre-load/ballast tanks 1098. A mud tower module (not shown) including dry mud storage and dry cement storage will be positioned outside the rig block as will cement pumps (not shown). The cement pumps will be powered by the generators 1094 of the rig block 1000. The mud and cement storage is located outside the block because of individual client requirements regarding particular mud treating systems and cementing systems to be used on any particular well. Therefore, standardization of bulk storage and treating facilities is not practical. It is necessary to locate the cement pump and blender in proximity to the cement storage. The position of the drill floor 1050 as cantilevered is shown in phantom.

Figure 14:
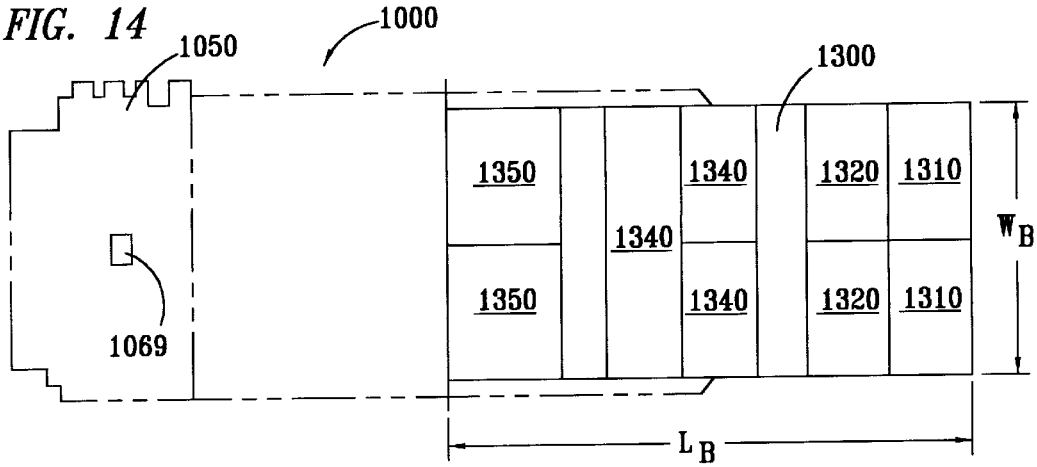
FIG. 14 is a plan view of the tank deck of the rig block of FIG. 11.

Referring now to FIG. 14, therein is illustrated the tank deck 1300. The tank deck includes mud pit cellar tanks 1310, drilling water tanks 1320 and fuel oil tanks 1340. The tank deck further includes additional pre-load/ballast tanks 1350. The position of the cantilevered drill floor 1050 is shown in phantom. The rig block 1000 further includes electrical wiring necessary to transfer power to and from the drilling equipment and all piping necessary to transfer fluids to the drilling equipment. It will be apparent to those skilled in the art that the aggregate rig block comprised of the heretofore described elements will be inherently non-buoyant.

The basic rig block 1000 will fit into each of the respective hull types. Individual MODU differentiation is achieved outside the rig block and consists of additional equipment for the rig type; i.e., legs and jacking system for a self elevating rig, columns and lower hulls for a semi-submersible rig, etc. However, drill floor mobility and location necessitates minor customization of the rig block depending on whether the block is utilized on a semi-submersible, jack-up, swamp barge or lake barge type rig. In the rig block used with a swamp barge rig or semi-submersible, the derrick is not cantilevered over the edge of the barge (see FIG. 7A). Therefore, the centerline of the drill floor will be located over a slot passing through the block 1000 in the position of where pre-load/ballast tanks are located for a block used on a jack-up rig or ballast trim tanks are located for the lake barge rig.

The rig block 1000 will be constructed by personnel familiar with rig components at a separate location from the shipyard. The rig block 1000 may be constructed concurrently with the construction of the barge hull, thereby saving construction time. It is estimated that construction for a rig block will take approximately six months and may cost one-third less than using historical assembly techniques of assembling the drilling elements component by component on the hull in the shipyard. The rig block is designed from the drilling floor down by rig builders. Historically, the rig elements have been designed from the hull up because most former MODU designers were naval architects.

When the rig block 1000 is completed in the fabrication yard, the block will be fully capable of drilling a well as it sits completed in the fabrication yard when provided with drilling mud, fuel, water, labor, drill pipe, drill collars and other like expendable items. The rig block 1000 will be tested and then shipped to the shipyard and assembled to the barge hull at the shipyard.

When rig block 1000 is positioned in one of the receiving slots 210, 310, 410 or 510 it is retained in position by a plurality of conventional connections. Any combination of welded plates and bolted connections as are known in the art may be used to maintain the rig block in position. Conventional alignment guides may be disposed proximal to the receiving slot on the hull and may be used to slidably engage cooperating guides on the rig block. Conventional stops disposed on the rig block or barge hull, or both, may be used to seat the rig block in correct alignment with the receiving slot of the barge hull. It will be understood by those skilled in the art that while the rig block may be fixably secured in place by conventional connections, these connections may be removed for interchangeablity of the rig block with other barge hulls or interchangeability of other rig blocks on the same barge hull. Said connections are designed in accordance with AISC Manual of Steel Construction and Classification Society Rules for building and classifying steel vessels and MODUs.

In the preferred embodiment, the rig block 1000 includes equipment sized to drill a 30,000 foot well. However, in an alternative embodiment the rig block may include down sized equipment capable of drilling a 20,000 foot well or used for workover service. Typical drilling equipment selected for use of the rig block is available from National/Oilwell Supply, DRECO, Varco and Caterpillar and may include:

| Equipment | 20,000 ft. Rating | 30,000 ft Rating |
|---|---|---|
| Draw works | National 1320 × 2 motors | National 1625 × 2 motors |
| Drill line | 1⅜ inch | 1½ inch |
| Electric brake | Baylor 7838 | Baylor 7838 + disc brake |
| Traveling block | B-500 | B-650 |
| Hook | HA-500 | HA-650 |
| Swivel | P-500 | P-650 |
| Rotary | D-375 | D-375 |
| Engines | 4 × Cat 3516 | 6 × Cat 3516 |
| Top Drive | Varco TDS-4 | Varco TDS-4 |
| Derrick | Dreco 30 × 30 × 1.33 MM | Dreco 30 × 30 × 1.96 MM |
| SCR | 4 bay × 2000 amp | 6 bay × 2000 amp |
| Mud Pumps | 2 × 12 P-160 | 3 × 12 P-160 |

It will be understood by those skilled in the art that the above-noted equipment may be interchanged with that of other equipment of similar type and function as is well known in the art. The drill floor will be arranged for a 30 to 40 foot base derrick, 170 feet high with a GNC of either 1.33 MM lbs. or 1.96 MM lbs depending on whether the rig is to have a 20,000 foot or 30,000 foot rating capacity. Derricks will all have the same profile and be configured for top drive drilling systems whether or not such a system is actually installed.

Although preferred and alternate embodiments of the present invention have been disclosed in the foregoing Detailed Description, it will be understood that the invention is not limited to the embodiments disclosed, but is capable of numerous rearrangements, modifications, and substitutions of parts and elements without departing from the spirit of the invention.

We claim:

1. A mobile offshore drilling unit including:

at least one hull member have an opening of predetermined size for receiving a separately fabricated non-buoyant interchangeable rig block;

a separately fabricated non-buoyant interchangeable rig block sized to be received in said opening, said block including:

a draw works, a drilling floor, and
a diesel/electric power system; and means for connecting the hull member to the rig block.

2. The mobile offshore drilling unit of claim 1 wherein the rig block further includes:

a main deck including:
the draw works,
the drilling floor, and
a plurality of pipe racks.

3. The mobile offshore drilling unit of claim 1 wherein the rig block further includes:

a machinery deck including:
the diesel/electric power system,
at least one mud pump, and
at least one mud tank.

4. The mobile offshore drilling unit of claim 1 wherein the rig block further includes:

a tank deck including:
at least one fuel tank, and
at least one drilling water tank.

5. The mobile offshore drilling unit of claim 1 wherein the mobile offshore drilling unit is a jack-up rig and the hull member further includes:

at least three movable legs; and a jacking means for raising and lowering said legs.

6. The mobile offshore drilling unit of claim 1 wherein the mobile offshore drilling unit is a semi-submersible rig including:

a pair of lower hulls;

at least four stability columns wherein two columns are affixed at a lower end to each of the lower hulls;

an upper hull including the opening for receiving the rig block, said upper hull mounted on an upper end of the stability columns.

7. The mobile offshore drilling unit of claim 1 wherein the mobile offshore drilling unit is a swamp barge rig wherein the hull is a generally rectangular member having a generally flat bottom and fixed upstanding opposing side walls, wherein at least two opposing sidewalls are generally vertical and at least one other side wall includes a portion of the side wall sloping outwardly from the bottom, said swamp barge rig floats when the rig is being moved from one location to another and said hull is at least partially submerged and rests on an inland marsh or inland lake bottom when the rig is in a drilling mode.

8. The mobile offshore drilling unit of claim 1 wherein the mobile offshore drilling unit is a lake barge rig wherein the hull is a generally rectangular member which floats when the rig is being moved from one location to another and said hull floats in the drilling mode.

9. The mobile offshore drilling unit of claim 1 wherein the rig block further includes:

a derrick sized for at least a 20,000 foot deep well.

10. The mobile offshore drilling unit of claim 1 wherein the rig block further includes:

a derrick sized for at least a 30,000 foot deep well.

11. A mobile offshore drilling unit including:

at least one hull member have an opening of predetermined size for receiving a separately fabricated non-buoyant interchangeable rig block; and a separately fabricated non-buoyant interchangeable rig block sized to be received in said opening, said block including:

a main deck including:
the draw works,
the drilling floor, and
a plurality of pipe racks;

a machinery deck including:
the diesel/electric power system,
at least one mud pump, and
at least one mud tank; and a tank deck including:
at least one fuel tank, and
at least one drilling water tank.

12. The mobile offshore drilling unit of claim 11 wherein the rig block further includes:

a derrick sized for at least a 20,000 foot deep well.

13. The mobile offshore drilling unit of claim 11 wherein the rig block further includes:

a derrick sized for at least a 30,000 foot deep well.

14. The mobile offshore drilling unit of claim 11 wherein the mobile offshore drilling unit is a semi-submersible rig including:

a pair of lower hulls;

at least four stability columns wherein two columns are affixed at a lower end to each of the lower hulls;

an upper hull including the opening for receiving the rig block, said upper hull mounted on an upper end of the stability columns.

15. The mobile offshore drilling unit of claim 11 wherein the mobile offshore drilling unit is a swamp barge rig wherein the hull is a generally rectangular member having a generally flat bottom and fixed upstanding opposing side walls, wherein at least two opposing sidewalls are generally vertical and at least one other side wall includes a portion of the side wall sloping outwardly from the bottom, said swamp barge rig floats when the rig is being moved from one location to another and said hull is at least partially submerged and rests on an inland marsh or inland lake bottom when the rig is in a drilling mode.

16. The mobile offshore drilling unit of claim 11 wherein the mobile offshore drilling unit is a lake barge rig wherein the hull is a generally rectangular member which floats when the rig is being moved from one location to another and said hull floats in the drilling mode.

17. A method of constructing a mobile offshore drilling unit including:

constructing at a marine shipyard a hull member having an opening of predetermined size for receiving a separately fabricated a non-buoyant interchangeable rig block;

separately assembling a non-buoyant interchangeable rig block sized to be received in said opening of the hull member, said step of assembling including:

constructing a main deck having a drilling floor, and mounting a draw works thereon, and constructing a machinery deck and installing at least one diesel driver, an electric generator, and at least one mud pump thereon; and installing the non-buoyant interchangeable rig block in the opening of the hull member and fixably connecting the rig block to the hull member.

18. The method of constructing a mobile offshore drilling unit of claim 17 wherein the step of separately assembling the interchangeable rig block further includes:

constructing a tank deck in said rig block and installing at least one fuel tank and at least one drilling water tank thereon.

19. A method of constructing a mobile offshore drilling unit including:

removing a first non-buoyant interchangeable rig block received in an opening of a separately assembled hull member;

replacing the first non-buoyant interchangeable rig block with a second non-buoyant interchangeable rig block including:

a main deck having a drilling floor, and a draw works thereon, and a machinery deck having at least one diesel driver, an electric generator, and at least one mud pump thereon; and installing the second non-buoyant rig block in the opening of the hull member and fixably connecting the second non-buoyant rig block to the hull member.

* * * * *